US005925978A

United States Patent [19]

Holzer

[11] Patent Number: 5,925,978

[45] Date of Patent: Jul. 20, 1999

[54] COILED GAS DISCHARGE TUBES FOR GAS DISCHARGE LAMPS

[76] Inventor: Walter Holzer, Drosteweg 19, D-88709 Meersburg, Germany

[21] Appl. No.: 08/769,770

[22] Filed: Dec. 19, 1996

[30] Foreign Application Priority Data

Dec. 22, 1995 [DE] Germany ..... 195 48 305

[51] Int. Cl.[6] ..... H01J 29/10

[52] U.S. Cl. ..... 313/493; 313/573; 313/634

[58] Field of Search ..... 313/493, 573, 313/634

[56] References Cited

U.S. PATENT DOCUMENTS 4,353,007 10/1982 Moerkens et al. ..... 313/493

4,521,837 6/1985 Bouchard ..... 313/493

5,705,883 1/1998 Soules et al. ..... 313/493

*Primary Examiner*—Vip Patel

*Attorney, Agent, or Firm*—Marshall, O'Toole, Gerstein, Murray & Borun

[57] ABSTRACT

A gas discharge tube (e.g., a lighting tube) comprising two coiled segments is described. The geometry of the coiled segments is such that the angle of the tangent to the center line of the tube with respect to the tube's longitudinal axis gradually increases as one moves upward along the ascending coiled segment, and gradually decreases as one moves down the descending coiled segment.

2 Claims, 2 Drawing Sheets

COILED GAS DISCHARGE TUBES FOR GAS DISCHARGE LAMPS

BACKGROUND OF THE INVENTION

Coiled gas discharge tubes or vessels have proven themselves best in the production of compact fluorescent lamps, not only because of their uniform all-around light distribution, but also because of the mechanical strength in comparison with welded tubes consisting of several individual parts.

Production of such coiled discharge tubes, however, is still problematical and not satisfactory, in spite of numerous attempts.

Moreover, previous methods did not permit production of double coils with an outside diameter of less than three times the diameter of the glass tube, since the small bending radii are very difficult or entirely impossible to produce.

The task of the invention is to describe a new form and also a method for the production of glass discharge vessels according to these designs, i.e., a gas discharge tube comprising two coiled tube segments.

SUMMARY OF THE INVENTION

The solution of the task consists of the fact that the glass tube in a doubly coiled gas discharge vessel consisting of a rising and descending part, which are connected by a terminal loop, which marks the region where the tube segments reverse direction, is configured so that the angle of the tangent to the center line of the glass tube (with reference to a plane perpendicular to the longitudinal axis) initially has a positive value in the coiled ascending part, which then assumes a larger value in the terminal loop and reaches the value "0" at the summit, then diminishes to a negative descending value with reference to the positive maximum and finally assumes in the descending part the negative value of the ascending part.

DETAILED DESCRIPTION OF THE DRAWINGS

The figures described below are only schematic examples for better understanding of the concept of the invention and are in no way to be interpreted as limiting. The same parts are designated with the same numbers.

Figure 1:
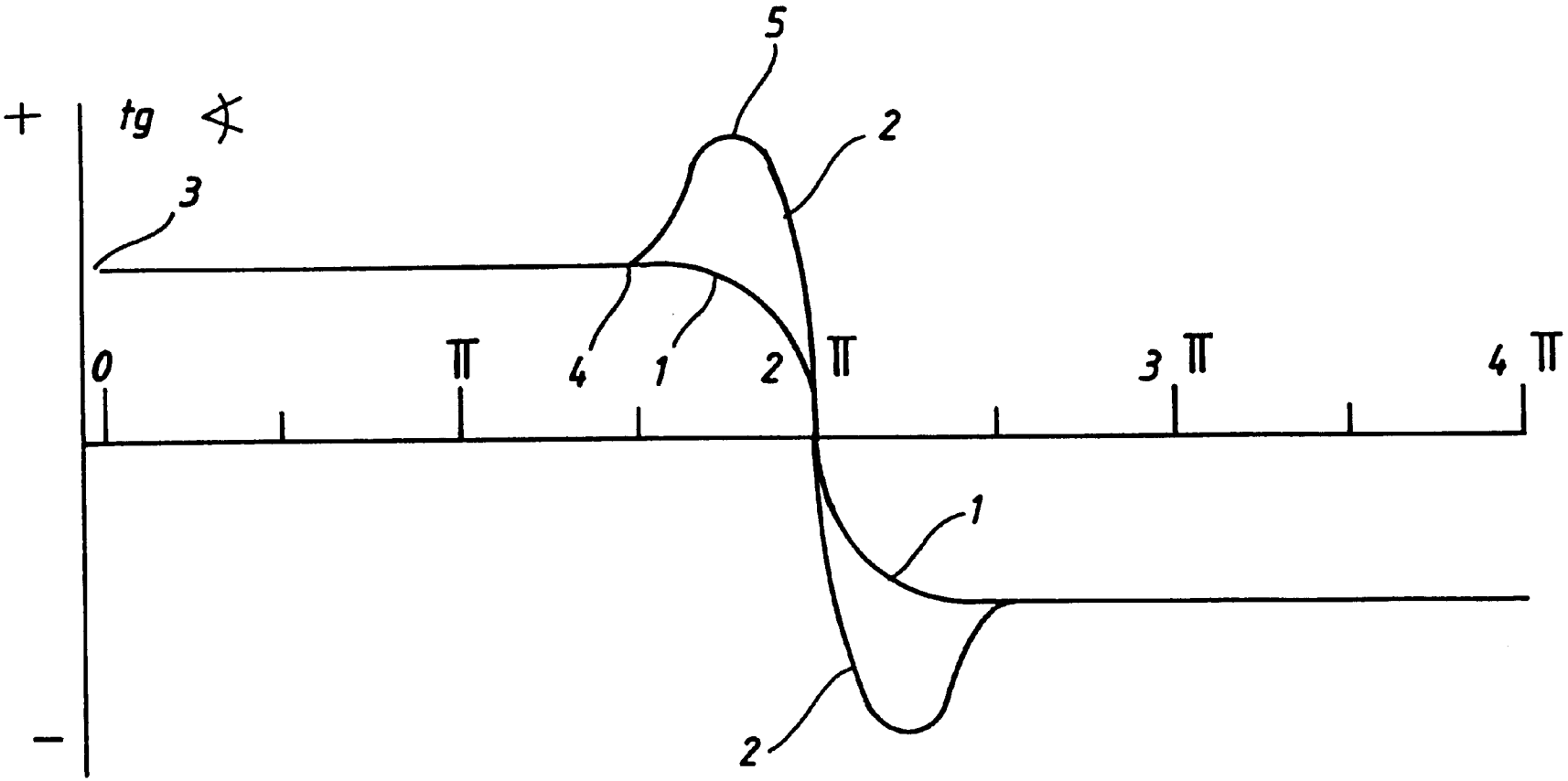
FIG. 1 shows the trend of the tangent angle in a diagram.

FIG. 1 shows the trend of a previously known coiling with line (1) for a trend of two turns, i.e., $4\pi$. The curve initially begins at point zero with a value (3) that remains almost constant during coiling. Only at point (4) does this tangent angle gradually diminish, crosses the zero point at the summit of the terminal loop and continues usually symmetrically to the end point of coiling at $4\pi$.

Line (2), which also begins at the same slope at a value corresponding to point (3) in the coil according to the invention, is different, not diminishing at point (4), but first rising further and finally reaching a maximum (5). Only then does the angle further diminish, crossing the zero line also at the summit (7) of the coil loop and then running symmetrically to the end of coiling at $4\pi$.

Figures 2, 3, 4, 5, 6:
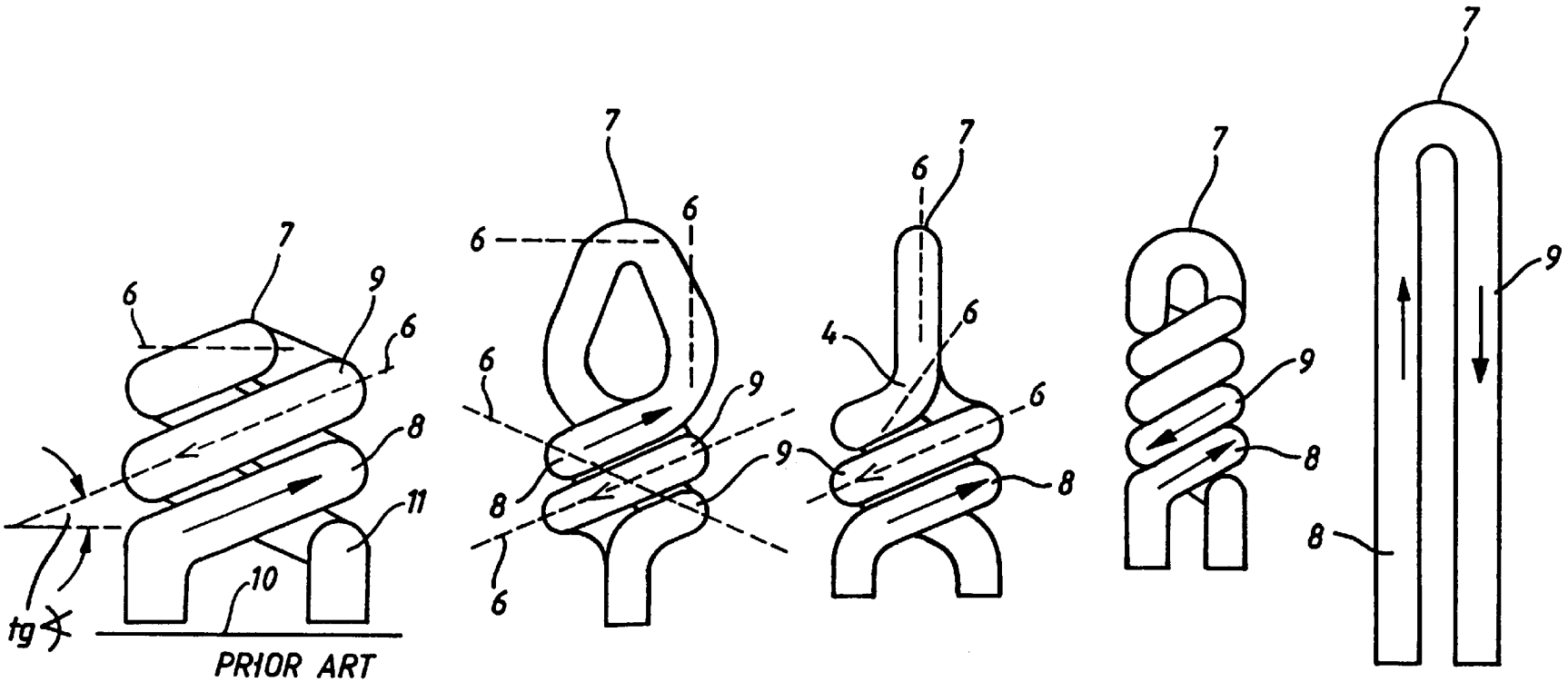
FIG. 2 shows a coil according to the prior art.
FIGS. 3 and 4 show a coil according to the invention in a front and side view, respectively.
FIG. 5 shows an extreme version of a coil according to the invention produced from a U-shaped glass tube, as depicted in FIG. 6.

It is clearly apparent in FIG. 2 in the coiled tube constructed version according to the prior art that the tangent (6) possesses a constant slope relative to reference surface (10) with a positive angle in the ascending part almost up to summit (7).

The situation is different in a gas discharge vessel according to the invention, as shown in FIGS. 3 and 4. Here the tangent angle rises almost to 90° after reaching the end of the ascending part (8), to diminish to zero at the summit. In the descending part (9), the tangent (6) diminishes to a corresponding negative value.

FIG. 4 shows the side view in which mostly the rise of the tangent angle at point (4) is readily apparent.

The extreme case depicted schematically in FIG. 5 would not be attainable at all according to the previous coiling methods. In this schematically depicted example, the outside diameter of the coiled gas discharge vessel is only somewhat larger than twice the glass tube diameter. Here again the same parts are designated with the same numbers.

FIG. 6 shows the U-shaped glass tube from which the gas discharge vessel of FIG. 5 is formed after coiling.

To summarize, it can be stated that by this novel configuration and simple method for its production significant cost and time savings can be achieved and solutions that were not conceivable with the previous coiling process are now possible.

Additional suggestions that are possible within the scope of protection of the invention and are part of the area of protection of the patent follow from the schematic depictions and the diagram.

I claim:

1. A coiled glass tube assembly for use in a compact flourescent lamp, the exterior surfaces of the tube assembly defining a center line extending throughout said coiled glass tube assembly, said tube assembly comprising:

an upwardly rising glass coil portion, a downwardly descending glass coil portion, and a terminal loop portion joined to an upper end of said rising coil portion at a first transition point, said terminal loop portion also joined to an upper end of said descending coil portion at a second transition point;

a longitudinally-extending center axis defined by said upwardly rising coil portion and said downwardly descending coil portion, said axis passing through the midpoint of said terminal loop portion;

the shape of the coiled glass tube assembly characterized by the fact that the tangent of the angle formed by the intersection of the tube assembly center line and the longitudinal axis with reference to a plane located beneath the rising and descending coil portions and perpendicular to said longitudinal axis has:

a) a positive value in said upwardly rising glass coil portion, b) a larger positive value between said first transition point and the point of intersection of the longitudinal axis and the loop portion midpoint, c) a value of zero at the point of intersection of the longitudinal axis and the loop portion midpoint, d) a negative value between said intersection point and said second transition point, and e) a smaller negative value in said downwardly descending glass coil portion; and an electrode at a sealed lower end of said rising coil portion and an electrode at a sealed lower end portion of said descending coil portion.

2. A coiled glass tube assembly for use in a compact flourescent lamp, the exterior surfaces of the tube assembly defining a center line extending throughout said coiled glass tube assembly, said tube assembly comprising:

an upwardly rising glass coil portion, a downwardly descending glass coil portion, and a terminal loop portion joined to an upper end of said rising coil portion at a first transition point, said terminal loop portion also joined to an upper end of said descending coil portion at a second transition point;

a longitudinally-extending center axis defined by said upwardly rising coil portion and said downwardly descending coil portion, said axis passing through the midpoint of said terminal loop portion;

the shape of the coiled glass tube assembly characterized by the fact that the tangent of the angle formed by the intersection of the tube assembly center line and the longitudinal axis with reference to a plane located beneath the rising and descending coil portions and perpendicular to said longitudinal axis has:

a) a positive value in said upwardly rising glass coil portion, b) a larger positive value between said first transition point and the point of intersection of the longitudinal axis and the loop portion midpoint, c) a value of zero at the point of intersection of the longitudinal axis and the loop portion midpoint, d) a negative value between said intersection point and said second transition point, and e) a smaller negative value in said downwardly descending glass coil portion; and an electrode at a sealed lower end of said rising coil portion and an electrode at a sealed lower end portion of said descending coil portion.

* * * * *